United States Patent [19]

Hegner

[11] 3,976,203

[45] Aug. 24, 1976

[54] CAN OR DRUM CHANGING DEVICE FOR FIBER SPINNING PLANTS

[75] Inventor: Gerhard Hegner, Neuenhain, Taunus, Germany

[73] Assignee: Friedrich Unde GmbH, Dortmund, Germany

[22] Filed: Nov. 8, 1974

[21] Appl. No.: 521,967

[30] Foreign Application Priority Data

Nov. 17, 1973 Germany ..... 2357428

[52] U.S. Cl. ..... 214/1 BC; 198/210

[51] Int. Cl.[2] ..... D01D 7/00

[58] Field of Search ..... 214/1 BC, 1 BH, 1 BD, 214/1 BV; 198/25, 34, 210

[56] References Cited

UNITED STATES PATENTS

| | | | |
|---|---|---|---|
| 2,888,131 | 5/1959 | Allen | 198/210 |
| 3,043,447 | 7/1962 | Lauck | 214/1 BC |

*Primary Examiner*—Robert J. Spar
*Assistant Examiner*—George F. Abraham
*Attorney, Agent, or Firm*—Malcolm W. Fraser

[57] ABSTRACT

A can or drum changing device for fiber spinning plants in which multi-fiber yarn supplied continuously from a textile finishing machine is fed into cans or drums for intermediate storage. The can or drum which is to be filled is placed on a fixed or movable platform, and the can changing device enables the filled can to be exchanged for an empty one. Both cans or drums are lifted before starting the changing procedure, and both lifting devices have a common pivot so that during the changing procedure, both cans approach each other and are freely suspended without interferring with each other. When the multi-fiber yarn from the textile finishing machine has filled one can, the continuous yarn is then transferred to the juxtaposed empty can, both cans being placed so close together at that time that the yarn cannot drop between them. The filled can is then lifted from the rotary table and the empty can is lowered onto such table.

6 Claims, 6 Drawing Figures

CAN OR DRUM CHANGING DEVICE FOR FIBER SPINNING PLANTS

BACKGROUND OF THE INVENTION

In the case of those fibre spinning plants, the endless multi-fibre yarn, which is supplied continuously, has to be laid continuously into cans after leaving the textile finish device connected in series with the spinning section and the take-up device. This means intermediate storage of fibre yarn, since in a subsequent procedure, the fibre yarns have to be extracted from several cans simultaneously and treated jointly. This procedure requires that the fibre yarn is laid accurately into the cans, i.e. it has to be laid uniformly and distributed evenly over the cross section so that there will be no cavities and at a later stage the yarn can be withdrawn from the filled can without knotting. To fulfill this requirement, the operating sequence must not be disturbed during can changing. However, it is also important that all cans contain the same quantity of fibre yarns, as otherwise it would result in wastage of yarns when joining the yarns from several cans.

Because cans are to be exchanged beneath the yarn which falls continuously like a water jet, the transfer of the yarn from the filled can into the empty can must take place as quickly as possible in order to prevent unnecessary waste due to yarn being dropped by the side of the can.

For this reason, repeated attempts have been made to carry out the changing of cans without intervention of the operating personnel, i.e. automatically, because this would best meet the above demands.

There are various kinds of yarn laying devices for fibre spinning. There are systems in which the can remains stationary, while the yarn is laid by yarn guide, which is controlled correspondingly, and systems in which the yarn guide remains stationary and the can performs corresponding motions. There are also systems which are a combination of the above named types, with corresponding variations. As soon as a can is filled on the yarn laying platform, it has to be exchanged for an empty one.

Because, at present, there is a tendency to use larger cans or drums for laying fibre yarns, and it is difficult for the operating personnel to lift the heavy cans, they are transported on roller conveyors or equipped with rollers. The can which is to be filled must always be placed accurately on the fixed or movable platform, or the rotary table. In the case of the usual yarn laying devices, it has proved difficult to combine the changing procedure into one working process and furthermore to make this into an automatic operation. There are automatic can changing devices, but they have not yet produced any solution which is generally satisfactory. They are either very expensive and require too much additional space which is not usually available for new plants and which does not exist at all in plants already in operation, or too long an interval occurs between the changing of the cans, resulting in a loss of product. Therefore, purely manual changing of cans is still preferred to a large extent.

SUMMARY OF THE INVENTION

The purpose of this invention is to produce a can changing device for fibre spinning plants where the filled can will be exchanged for the empty one in a single working step, were no waste of product occurs and where automatic changing procedures are possible.

This invention relates to a can changing device for fibre spinning plants in which multi-fibre yarn, supplied continuously from the textile finish device, is laid into cans for intermediate storage and the can which is to be filled is placed upon a fixed or movable platform and the can changing device allows the filled can to be exchanged for an empty one.

According to this invention, the system comprises: lifting device for the can or drum in filling position, lifting device for the empty can, support housing for the lifting device of the can in filling position, support section for the lifting device of the empty can, common rotary column with fixed gear ring, around which the support housing and support section rotate, drive with motor, gear, support housing pinion, crank gear pinion and with crank gear, all elements fixed to the support housing, and connecting rod between crank gear and support section through which an additional rotary motion is induced to the support section.

An additional feature of the invention provides that the gear ratio of the fixed gear ring and the support housing pinion on the one hand, and of the fixed gear ring and crank gear pinion on the other hand, are chosen in such a way that, during the changing process, the lifting devices at the support housing and at the support section periodically alter the distance between them within two limits.

Another feature of the invention is that the lifting devices for the filled and empty can are coupled with the drive of the can changing device, to insure a fully automatic can changing procedure. If it is impossible to alter the additional field of traverse of the support section, the connecting rod will be designed adjustable also in its length and pivotal point at the support section.

Particular characteristics and advantages of the invention are that both cans or drums are lifted before starting the changing procedure, that during the changing procedure, both cans approach each other, freely suspended, without constituting a hindrance to each other on the rotary table or on the feed and/or take-off roller trains. Moreover, a permanently synchronized changing procedure is ensured by the drive-end coupling, according to the invention, of the support section for the empty can at the support housing.

Other advantages of the invention are that, at the moment of can or drum changing, i.e. when the yarn transfers from the filled can to the empty can, both cans are placed so close together, that the yarn cannot drop down between them and the filled can will be lifted from the rotary table and the empty one lowered smoothly on to the rotary table. The can changing device, according to the invention, may be used with all known fibre yarn laying systems, i.e. with fixed or moving yarn feeding device and/or with fixed or moving platform. On account of the small space requirement, it can be installed into existing fibre spinning plants. Its compact design ensures safe operation to a high degree.

The corresponding motions of the can changing device are produced by means of mechanical, pneumatic, hydraulic or electrical instruments. By means of contacts, switches or other control devices any desired motion, i.e. any can changing procedure is possible, depending on the filling level of the filled can. In accordance with invention, the can changing device is fully automatic, i.e. no operating personnel is necessary, but only personnel for supervision.

BRIEF DESCRIPTION OF THE DRAWINGS

An embodiments of the invention is shown in the drawings, in which.

DESCRIPTION OF THE PREFERRED EMBODIMENT

Figure 1:
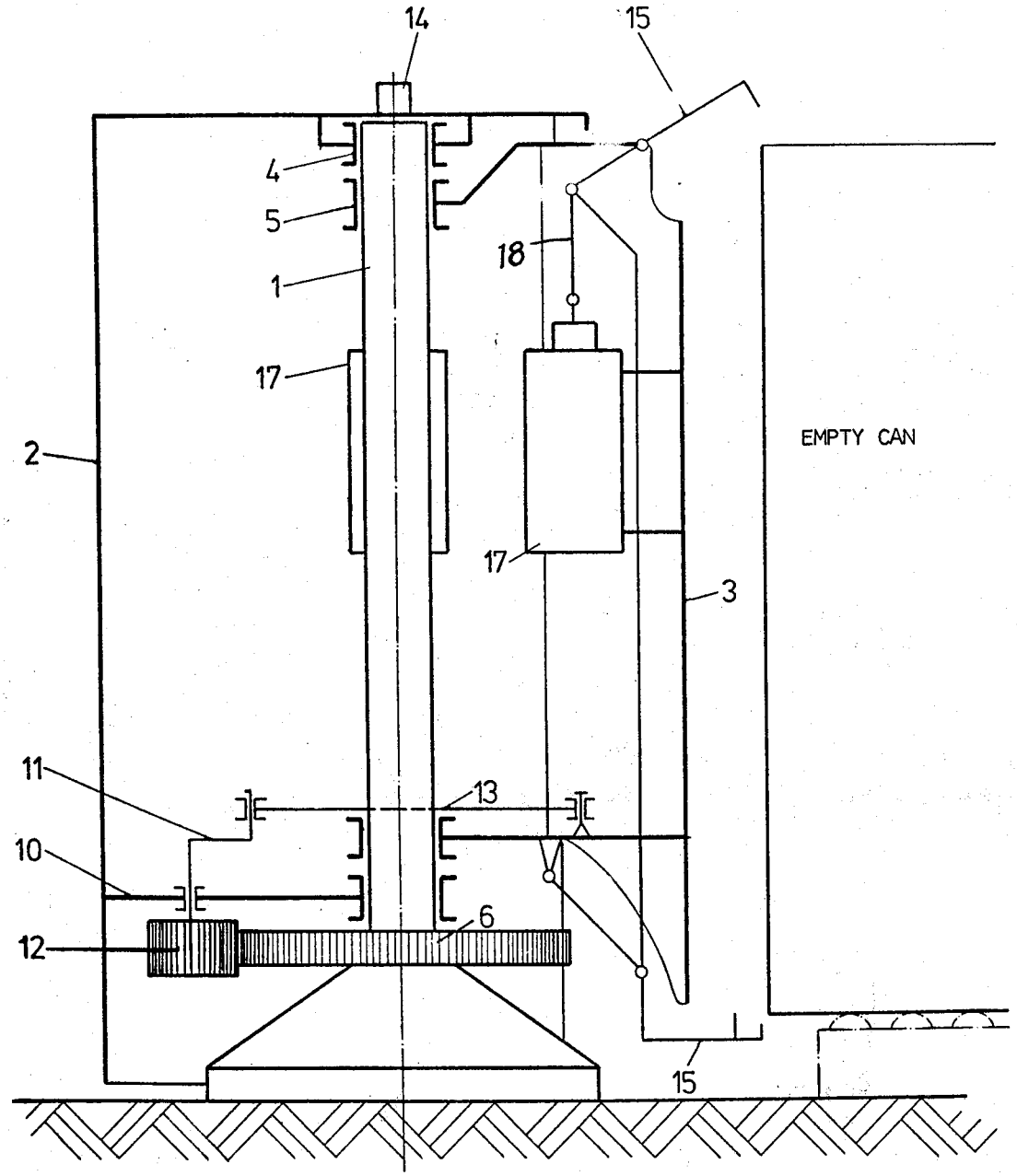
FIG. 1 is a schematic view in vertical section of the can changing device with an empty can.
Figure 2:
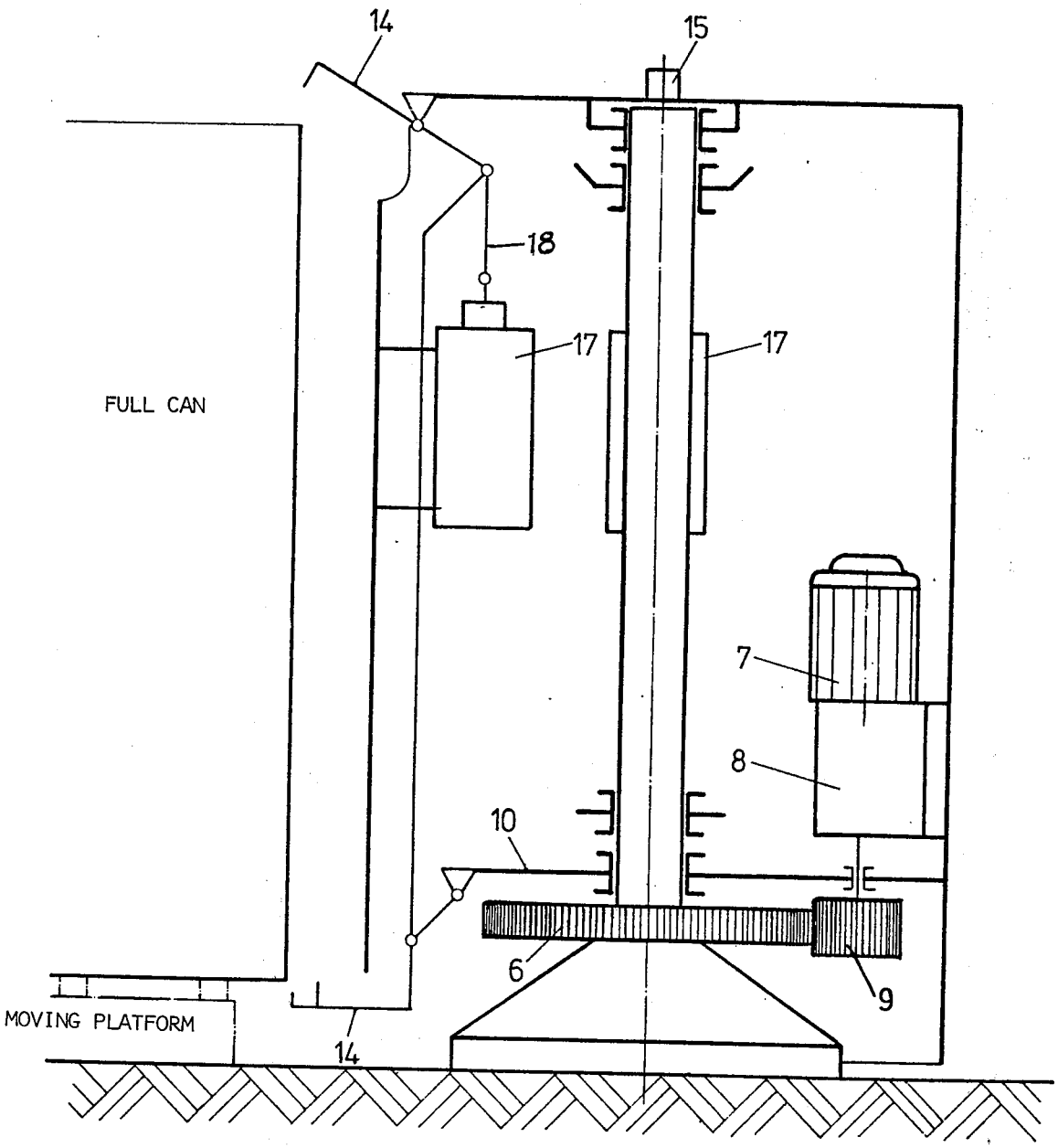
FIG. 2 is a view similar to FIG. 1, but with a filled can.
Figure 3:
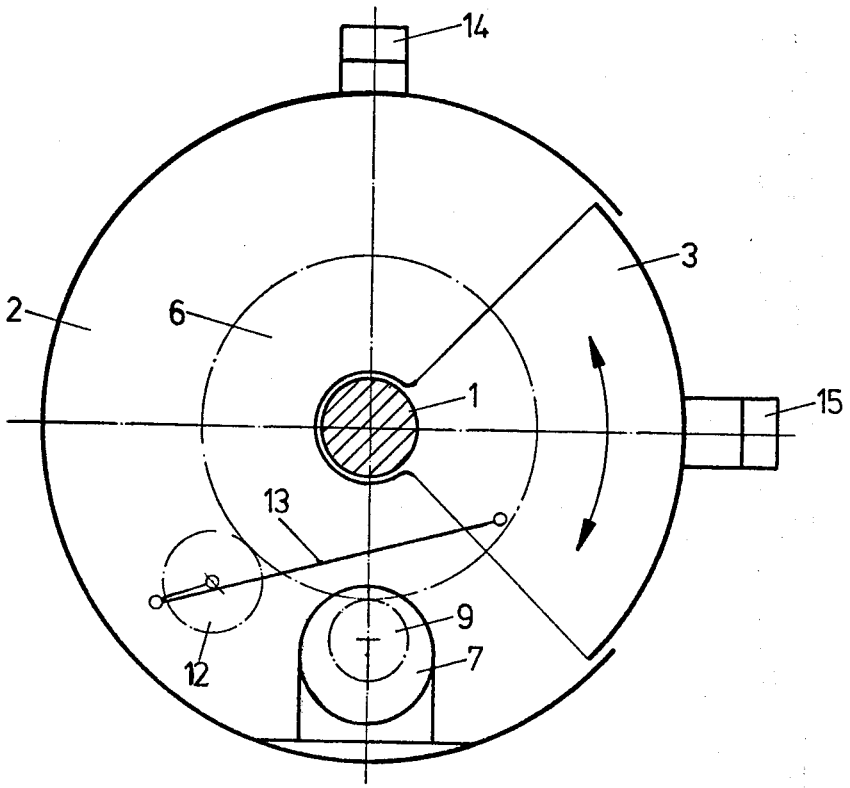
FIG. 3 is a schematic view in transverse section of the can changing device.

Referring to FIGS. 1, 2 and 3, a support housing 2 for the filled can or drum and a support section 3 for the empty can vertically rotate around bearings 4 and 5, and are mounted on a rotary column 1, the support for which is firmly fixed to the floor. A gear ring 6 is rigidly fixed to the rotary column 1. A motor 7, mounted on the support housing 2, drives a support housing pinion 9 by means of a gear train 8. The pinion 9 meshes with the gear ring 6, thereby turning the support housing 2 around the rotary column 1. A crank gear 11 is supported on a bearing arm 10 of the support housing 2 in such a way that a crank gear pinion 12 also meshes with the gear ring 6, and on rotation of the support housing 2 around rotary column 1, this pinion drives the crank gear 11. A connecting rod 13 is supported at one end on the crank gear 11 and at the other end on the support section 3. This ensures that the crank gear 11 imparts through the connecting rod 13 a rotary motion to the support section 3 relative to the rotary motion of support housing 2. This means a faster or slower rotation of the support section 3 as compared to the support housing 2. As a result, lifting devices 14 and 15 for the filled and the empty cans show a maximum or minimum distance in the respective dead position of the crank gear. Pivotally mounted lifting devices 14 and 15 are each operated by one pneumatic cylinder 17 with a connecting rod 18. The lifting devices 14 and 15 may be operated by hydraulic, electric or magnetic cylinders, as desired.

Figure 4:
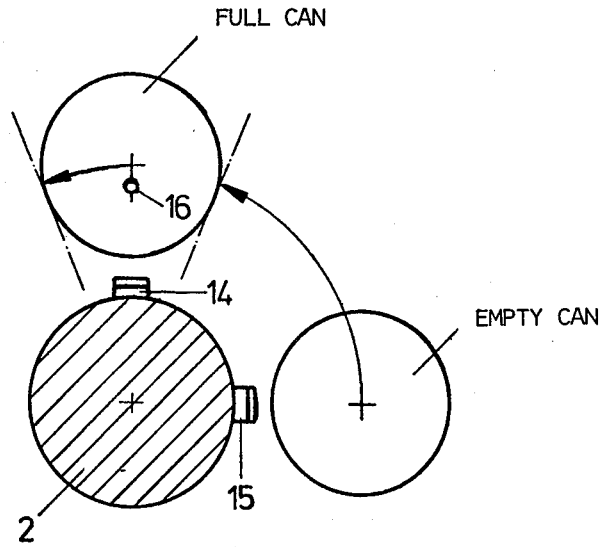
FIG. 4 is a schematic view of the can changing device before the changing procedure.
Figure 5:
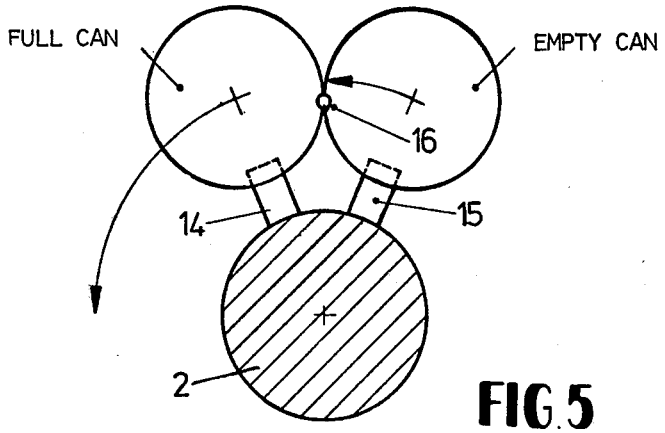
FIG. 5 is a schematic view of the can changing device during the changing procedure.
Figure 6:
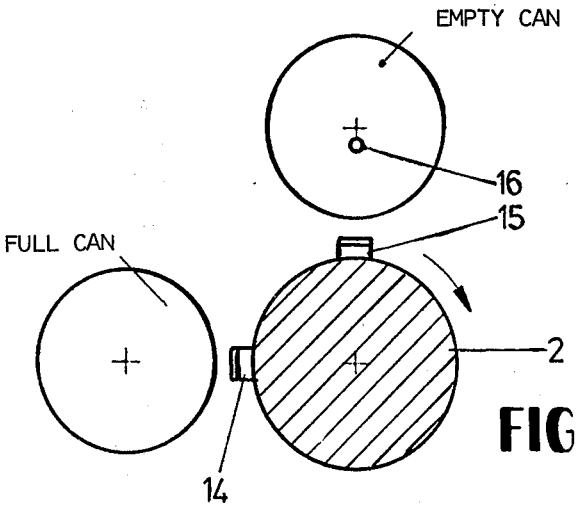
FIG. 6 is a schematic view of the can changing device after the changing procedure.

The changing procedure of a filled can for an empty one is shown in FIGS. 4, 5 and 6, and is described in detail below.

An empty can is placed in front of the lifting device 15, whereas the can which is to be filled is placed in front of lifting device 14 below fibre yarn feed 16.

For this example, it may be assumed that the can which is to be filled is placed on a rotary table 3, which performs the motions for obtaining the filled can, and that the yarn feed 16 is stationary. The changing procedure is started by actuating a switch (not shown) as soon as the can which is being filled has reached the intended filling level.

At first, both lifting devices pick up both cans and raise them as much as is necessary until they are able to rotate freely. Motor 7 immediately stars rotating the support housing 2 and the support section 3 around the rotary column 1. Lifting device 14, complete with filled can, turns uniformly through 90°, whereas the lifting device 15 on the support section or table 3 performs a swinging rotary motion through 90°, relative to the lifting device 14, i.e. the lifting device 15 on the support section 3 is driven additionally by a crank gear 11 and a connecting rod 13 until the crank gear has reached the lowest dead point. The connecting rod 13 is preferably adjustable in length, and its pivotal connection with the support section 3 is also adjustable. After the lowest dead point has been passed, the rotary motion will be slowed down. This moving procedure ensures that during the changing procedure, the distance between both cans will be zero, (FIG. 5) when the fibre yarn is delivered to the empty can, and that the distance between the cans returns to the original value (FIG. 6). The yarn is prevented from dropping down along side of the can because the two cans are in such close juxtaposition.

When, after a rotation of 90°, the changing procedure is completed, limit switches (not shown) control the rotary motion, and the lifting devices return to their positions of rest and lower the filled can and the empty can (FIG. 6). The empty can now stands on the rotary table 3 and is filled with the yarn which is being continuously fed. The filled can is brought out of range of the yarn feed and is ready for transportation after the yarn has been severed. By means of a timing relay (not shown), the support housing 2 and the support section 3 are then returned to the starting position (FIG. 4) together with the lifting devices 14 and 15 which are in rest positions. The support housing 2 and the support section 3 are now ready for the next changing procedure. Automatic severing of the fibre yarn may take place in any suitable manner at the moment the filled can is being exchanged for the empty one, if desired.

What I claim is:

1. Device for filling cans or drums with multi-fibre yarn, including;

1. a multi-fibre yarn feeding station,

2. a lifting device for a can in filling position,

3. a rotatable housing on which said lifting device is mounted for moving a can to said feeding station,

4. a lifting device for a succeeding can to be filled,

5. a rotary support section movable concentrically to said housing and on which said second lifting device is mounted,

6. a support column common to said housing and support,

7. a ring gear fixed to said column,

8. a motor on said housing operatively connected to said ring gear for rotating said housing and support section,

9. A crank gear connected to be driven by said ring gear, and

10. a connecting rod operatively connecting said crank gear and said support section, whereby an additional rotary motion is imparted to said support section relative to said support housing.

2. A can or drum filling device as claimed in claim 1, including a pinion driven by said motor and engaging said ring gear, another pinion engaging said ring gear and driving said crank gear, and the gear ratio of said ring gear to said pinions being such that during the can changing operation, said lifting device on said support housing and on said support section periodically alter the distance therebetween within two limits.

3. A can or drum filling device as claimed in claim 1, including means for operating each lifting device operatively to engage a can and lift same to filling position and discharge same at predetermined intervals.

4. A can or drum filling device as claimed in claim 1, including means for length adjusting said connecting rod and altering the pivot connection thereof to said support section.

5. A can or drum filling device as claimed in claim 1, characterized that said lifting devices are coupled with the drive of said housing and support section.

6. Device for filling cans with continuous multi-fibre yarn of a fibre spinning plant including

1. a rotary housing,

2. a rotary support section coaxial with said housing,

3. a separately operated can supporting device for each of said housing and support section and carried respectively thereby for lifting and disposing the cans successively in yarn-receiving position,

4. means for imparting conjoint rotary movement to said housing and support section, and

5. separate means for imparting additional rotary movement to said support section for moving the cans close together or farther away from each other in the region of the yarn feed.

* * * * *